United States Patent [19]

Nakazaki et al.

[11] 4,300,224

[45] Nov. 10, 1981

[54] ELECTRONIC TIMEPIECE

[75] Inventors: Yasunori Nakazaki; Tatsushi Asakawa, both of Suwa, Japan

[73] Assignee: Kabushiki Kaisha Suwa Seikosha, Tokyo, Japan

[21] Appl. No.: 952,371

[22] Filed: Oct. 18, 1978

[30] Foreign Application Priority Data

Oct. 18, 1977 [JP] Japan ..... 52-124846

[51] Int. Cl.[3] ..... G04B 17/12; G04B 17/16; G04B 17/00

[52] U.S. Cl. ..... 368/201; 368/200; 368/184

[58] Field of Search ..... 58/23 R, 85.5; 307/223 R, 238; 328/48; 368/184, 185, 186, 187, 188, 189, 200, 201, 202

[56] References Cited

U.S. PATENT DOCUMENTS 3,646,371 2/1972 Flad ..... 307/293
3,895,486 7/1975 Hammer et al. ..... 58/23 R
4,016,508 4/1977 Kobori ..... 331/116 R
4,020,626 5/1977 Kuwabara et al. ..... 58/23 R

*Primary Examiner*—S. J. Witkowski
*Assistant Examiner*—John B. Conklin
*Attorney, Agent, or Firm*—Blum, Kaplan, Friedman, Silberman & Beran

[57] ABSTRACT

An electronic timepiece comprising a fundamental frequency oscillator, a plurality of frequency divider stages, a timekeeping mechanism and display, includes circuitry for resetting and setting selective stages of the divider and thereby adding or subtracting timing pulses which are delivered to the timekeeping mechanism. A non-volatile memory stores data which terminates whether a divider stage is to be set or reset. Additionally, a plurality of circuit elements are selectively inserted to modify the circuit of the oscillator and to provide frequency adjustment. External contacts are provided for the inputting of data to memory and for measuring timing rate against an external standard.

33 Claims, 23 Drawing Figures

FIG. 9A
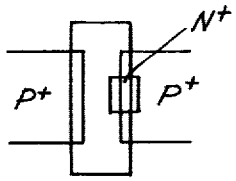
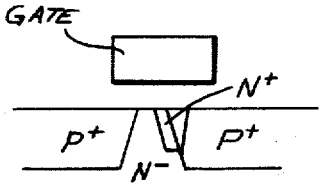
FIG. 9B
FIG. 10
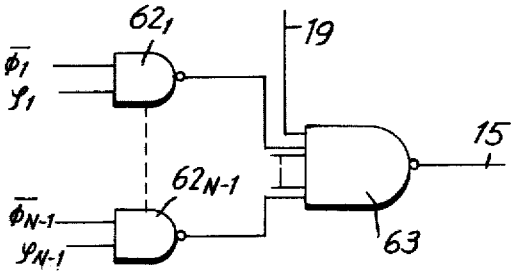
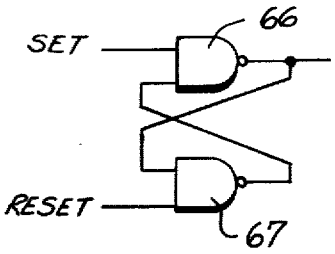
FIG. 12
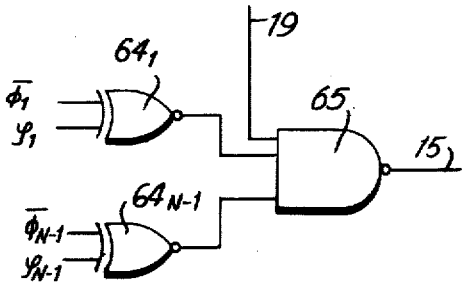
FIG. 11
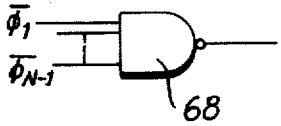
FIG. 13
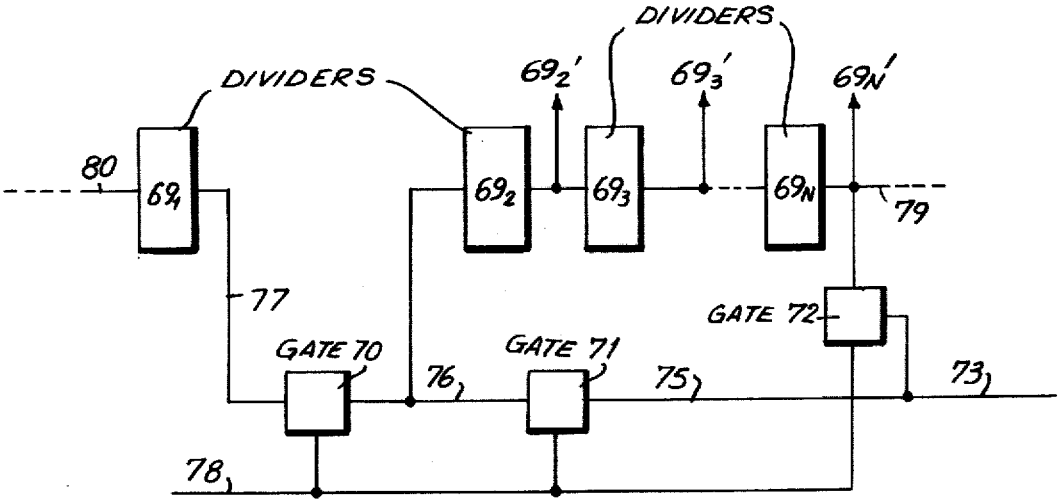
FIG. 14

ELECTRONIC TIMEPIECE

BACKGROUND OF THE INVENTION

This invention relates generally to an electronic timepiece and more particularly to an electronic timepiece comprising a fundamental frequency oscillator which feeds a plurality of frequency divider stages. Ideally in an electronic timepiece the fundamental frequency oscillator will put out an exactly predetermined frequency of signals. In conjunction with this precise frequency output, the divider would have a precisely determined number of stages to produce a lower frequency of the exactly desired rate suited to drive a timekeeping mechanism. Unfortunately, it is rarely possible to get the exact frequency from the oscillator which is desired. Accordingly, it is necessary to be able to determine the actual frequency output of a timepiece and to provide means for adjusting the timing rate from that timepiece to bring the accuracy of timekeeping within acceptable limits. In the prior art this has frequently been down by providing a trimmer capacitor in the oscillator circuit. However, there are several drawbacks to this technique for adjusting oscillator frequency. Generally speaking, the trimmer capacitor is most successful when the adjustment is to be made over only a narrow range of frequency. When the frequency is to be adjusted over a wide range of frequencies, the oscillations tend to become unstable. Also, the oscillation starting voltage becomes high. Further, when using the trimmer capacitor precise adjustment is a delicate procedure and the results are unstable. As a result, the adjustment of the timing rate is a time consuming procedure. Further, a trimmer capacitor is an expensive component and occupies a considerable volume of space in the timepiece.

What is needed is an electronic timepiece which can be adjusted to a highly accurate timing rate without the need for a trimmer capacitor. Also, it is desirable that these frequency adjustments can be made simply and rapidly and without the need to open the timepiece.

SUMMARY OF THE INVENTION

This invention relates to timekeeping circuitry from which the trimmer capacitor has been eliminated. The electronic timepiece of this invention comprises a fundamental frequency oscillator of high stability feeding pulses into a plurality of frequency divider stages, the output of which drives a timekeeping mechanism and display. Two techniques for adjusting the timing rate are provided in the circuitry. The first technique adjusts the output rate of the fundamental frequency oscillator by inserting or removing one or more of a plurality of circuit elements such as small capacitors which are availalbe within the circuit thereof. The frequency of the oscillator is altered depending on which of these circuit elements are included or isolated from the circuit. Selection of the circuit elements is controlled by the output frequency of the divider stages and by data stored in memory. The second technique of frequency adjustment operates on the divider stages and resets any selected stages in the divider chain to thereby eliminate or delay pulses delivered to the timekeeping mechanism. Also, provision is made to set divider stages to add pulses which are delivered to the timing mechanism. Whether a divider stage is to be set or reset is controlled by data stored in the memory. The data stored in the memory is derived from signals outputted by the divider stages and analyzed externally of the timepiece. Externally derived frequency adjustment signals are written into the memory by means of terminals provided on the timepiece. A non-volatile memory is preferred. Both frequency adjustment techniques cooperate to provide an accurate timepiece.

Accordingly it is an object of this invention to provide an electronic timepiece which is highly accurate in its timing rate.

Another object of this invention is to provide an electronic timepiece in which the frequency rate may be adjusted over a wide range of frequency.

Still another object of this invention is to provide an electronic timepiece wherein the frequency rate may be adjusted without the use of a trimmer capacitor.

A still further object of this invention is to provide an electronic timepiece wherein the frequency rate may be adjusted by modifying the output of the fundamental frequency oscillator and by modifying the ratios in the divider stages.

A still further object of the invention is to provide an electronic timepiece which can be adjusted rapidly and whose accurary can be measured rapidly by using external means.

Yet another object of this invention is to provide an electronic timepiece having a memory which can be written into from external sources.

Another object of this invention is to provide an electronic timepiece wherein frequency divider stages serve as a storage register when data is inputted into the memory.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 4 through 16 are circuits of functional elements suited for the timepiece of FIGS. 1 and 2;

DESCRIPTION OF THE PREFERRED EMBODIMENTS

Figure 1:
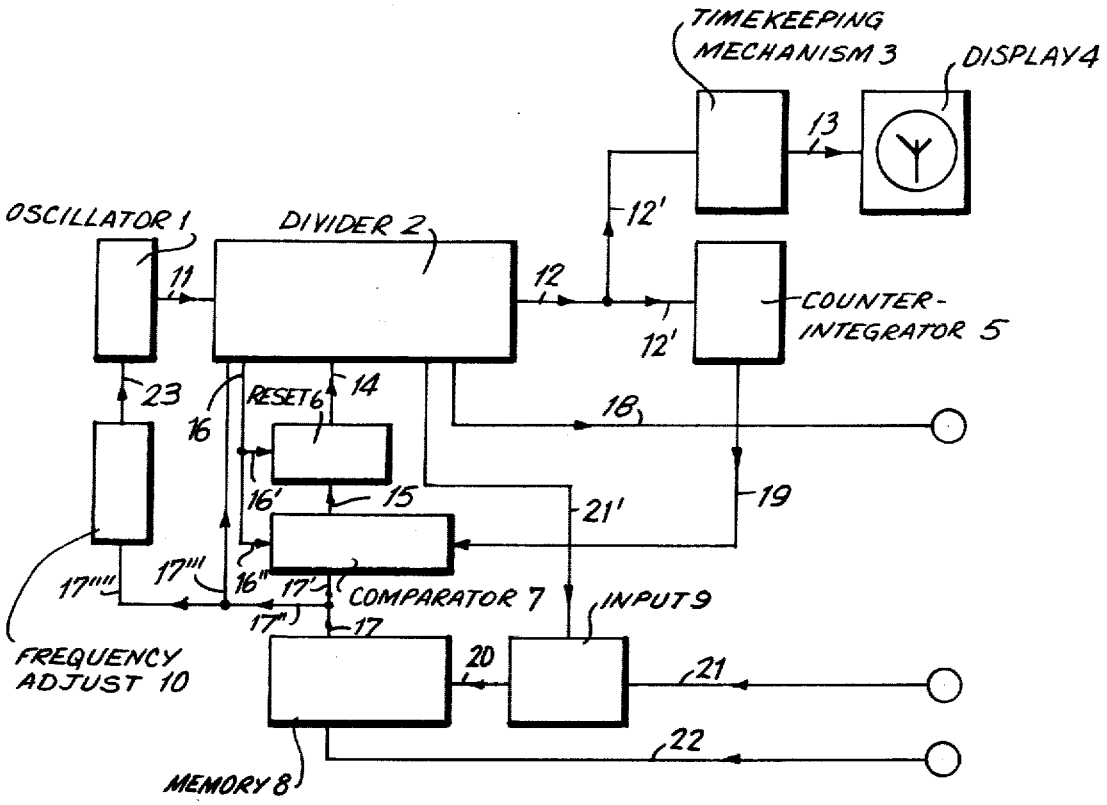
FIG. 1 is a functional block diagram of a regulated timepiece according to this invention.

With reference to the functional block diagram of FIG. 1, the timepiece of this invention comprises a fundamental frequency oscillating source 1, a divider 2, a timekeeping mechanism 3, integrating counter circuit 5, reset circuit 6, comparator 7, and memory 8. An input 9 is provided for writing into the memory 8, and the display device 4 provides an external indicator of time.

The signal from the fundamental frequency oscillating source 1 is applied to the divider 2. The output 12 of the divider 2 is applied to the timekeeping mechanism 3 and the display device 4 is driven by the timekeeping mechanism output 13. The output 12 is also applied to the counter 5. The counter 5 lowers the frequency of the output 12 and counter output 19 is generated thereby, and applied to the comparator 7. When the output 17′ from the memory 8 and the output 16″ from the divider 2 agree with each other, the comparator 7 is driven and the output 15 is generated. When the output 15 is applied to the reset circuit 6, the reset circuit 6 continuously applies a reset signal 14 until the divider stage to be reset within the divider 2 is confirmed to be reset by the output 16′. This reset signal to the divider can also be a set signal with respect to some divider stages as is described in detail hereinafter.

The oscillating frequency of the fundamental frequency oscillating source 1 is also adjusted by the fundamental oscillating frequency adjusting circuit 10 in response to the outputs 17′′′′ of the memory 8.

Figure 2:
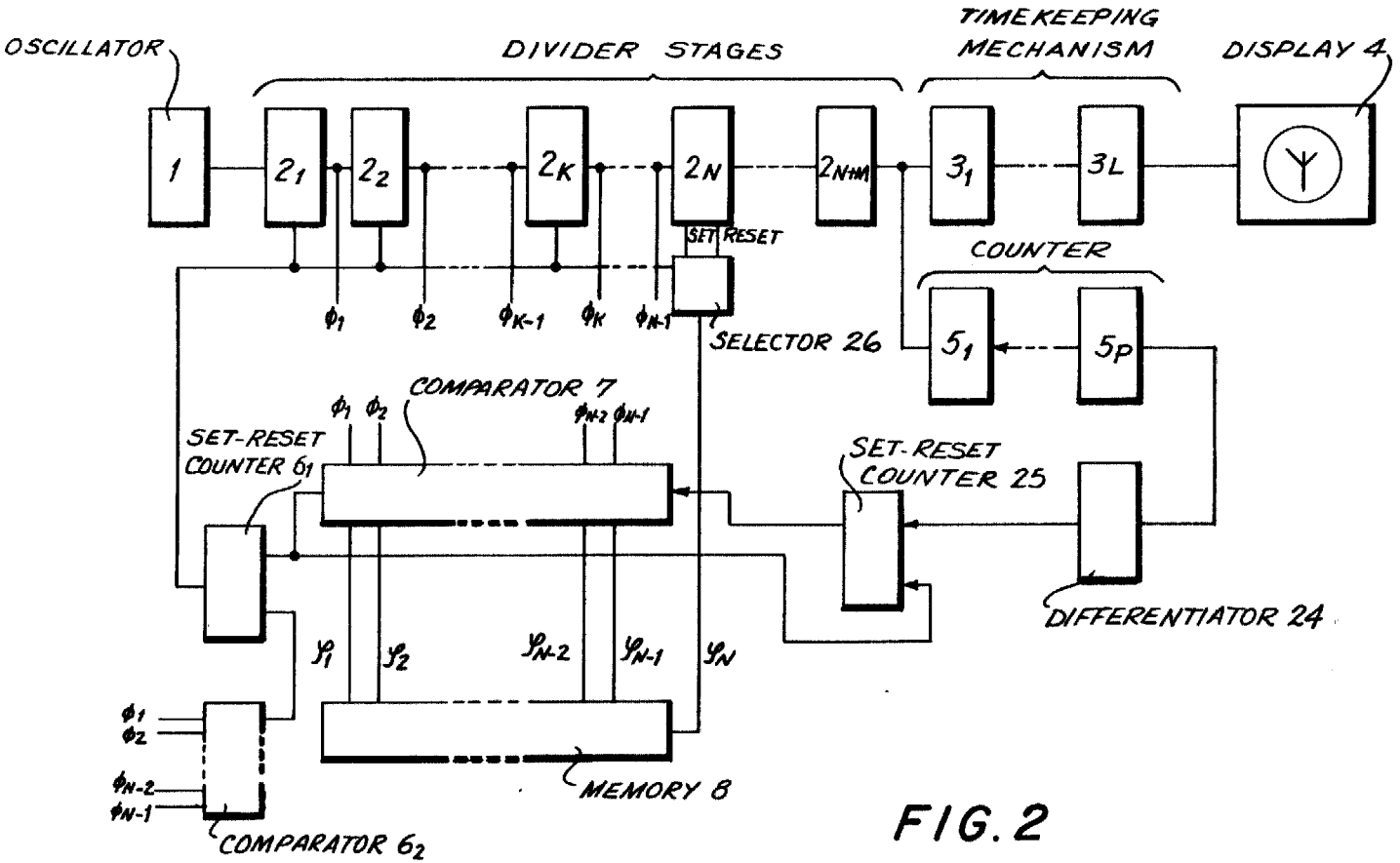
FIG. 2 is a functional block diagram in greater detail showing the timepiece of FIG. 1.

Next, the regulating means according to the invention is described in detail in conjunction with FIG. 2 wherein numbers 1, 2, 3, 5, 6, 7 and 8 reference similar circuit functions as those in FIG. 1. The subscript numbers, for examples, $2_1$ and $2_2$, represent stages 1 and 2 of the divider 2. The circuit of FIG. 2 further includes differentiation circuit 24, set-reset counters 25, $6_1$, comparator $6_2$ and selecting circuit 26.

In FIG. 2 only stage $2_N$ is a set-reset type counter stage in the divider 2 for the purpose of simplifying the description here. However it is acceptable to have any counter in the divider 2 be of the set-reset type, or to have a plurality of counters of such type. The output from the fundamental frequency oscillating source 1 passes through the divider 2 and is displayed in the display device 4 of the timekeeping mechanism 3. The output from the divider 2 is also applied to the counter 5 and the frequency of the divider output is further reduced. The output from the counter 5 is differentiated by the differentiation circuit 24 and the differentiated output sets the set-reset counter 25. When the counter 25 is set, comparator 7 is driven by the output of the said counter 25.

The comparator 7 compares the logic conditions of outputs $\emptyset_1$ to $\emptyset_{N-1}$ from the divider stages with those of the outputs $\phi_1$ to $\phi_{N-1}$ from the memory 8 and applies a setting input into the set-reset counter $6_1$ at the moment when those conditions of the outputs agree with each other. The output of the comparator 7 also resets the set-reset counter 25 which remains in that condition until the next pulse output arrives from the differentiator 24. The set-reset counter $6_1$ at its output applies a reset signal to the divider stages 1 to N−1. At this time, the signal from the set-reset counter $6_1$ is selected in the selecting circuit 26 by the output $\phi_N$ of the memory 8 and is applied as the set signal or reset signal to the divider stage N. The set-reset counter $6_1$ applies the reset signal until $\emptyset_1$ to $\emptyset_{N-1}$ are all confirmed in the comparator $6_2$ to be at the reset level. When the comparator $6_2$ confirms that the divider stages 1 to N−1 are reset, a reset signal is applied by comparator $6_2$ to the set-reset counter $6_1$. One cycle of the divider frequency adjustment is thus completed.

Now, operation of the selecting circuit 26 is described when the condition of the selecting circuit 26 is enabled, by the output $\phi_N$ of the memory 8, to apply a reset signal to the divider $2_N$. In this condition, dividers $2_1$ to $2_{N-1}$ are reset when the outputs $\emptyset_1$ to $\emptyset_{N-1}$ reach the logic state which matches the output $\phi_1$ to $\phi_{N-1}$. Consequently, when the divider 2 is constituted of binary counter stages, the following pulse $L_A$ is eliminated:

$$L_A = 2^0 \cdot \phi_1 + 2^1 \cdot \phi_2 + \ldots + 2^{N-2} \cdot \phi N - 1.$$

Next described is that condition when the selecting circuit 26 is enabled by the output $\phi_N$ of the memory 8 to apply a set signal to the divider $2_N$. The following pulse $L_A$ is eliminated:

$$L_A = 2^0 \cdot \phi_1 + 2^1 \cdot \phi_2 + \ldots + 2^{N-2} \cdot \phi N - 1.$$

However, in this case as the divider $2_N$ is set, the following pulse is added:

$$L_B = 2^{N-1} - L_A.$$

As stated above, according to the state of $\phi_N$, the frequency can be easily regulated into both higher and lower rates of divider output for application of the timekeeping mechanism 3. The divider stage which is to be set is not limited to stage $2_N$ as described above. In alternative embodiments of this invention any divider stage and any number of divider stages may be set. In such a case, the number of pulses of frequency which will be regulated to raise or lower the rate to the timekeeping mechanism does not follow the above equations. By making N, i.e., the quantity of divider stages, as large as possible, the frequency can be adjusted over a wide range.

When the counter stages in this invention are binary counters and the frequency of the output of the fundamental frequency oscillating source 1 is $2^{N+M+L}$, the accuracy according to this invention is as follows:

$$\Delta t = 2^{-(N+M+L+P)}$$

Accordingly, if P is made larger, the accuracy becomes better in proportion thereto. However, making P larger has the following disadvantages:

The circuit elements are increased in number. The power consumption increases in proportion to the increasing number of elements. The time required for measuring the accuracy of the timepiece is extended.

Figure 3:
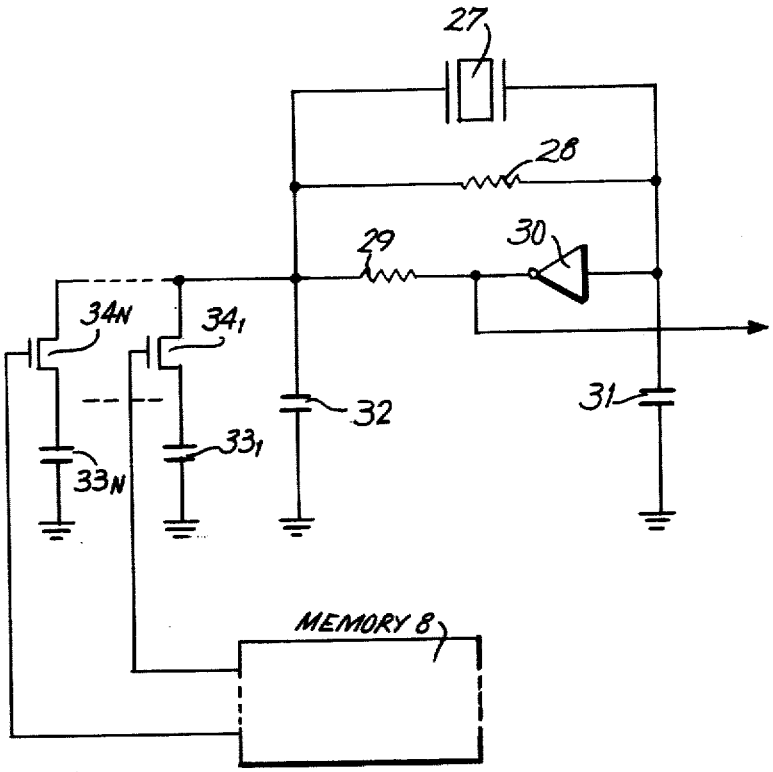
FIG. 3 is a semi-schematic diagram of the oscillator and frequency adjustment circuits of the timepiece of FIG. 1.

Therefore, in this invention, the fundamental oscillating frequency regulating circuit 10, shown in FIG. 1, is provided in order to limit the value of P to a suitable value and to obtain high accuracy. The mechanism of the frequency adjustment circuit 10 is described in greater detail with reference to FIG. 3 and includes a piezoelectric element 27, resistors 28, 29, an inverter 30, and capacitors 31, 32. These elements constitute the fundamental frequency oscillating source 1 shown in FIG. 1. Additionally, the circuit 10 includes MOS transistors $34_1$ to $34_N$ and capacitors $33_1$ to $33_N$. They constitute the fundamental oscillation frequency regulating circuit 10 in FIG. 1. Applying the principles of a trimmer capacitor, the oscillation frequency is adjusted in this circuit by changing the capacitance in the resonator. The capacitors $33_1$ to $33_N$ are selected by properly getting the MOS transistors $34_1$ to $33_N$ ON according to the output of the memory 8. For example, capacitor $33_1$ acts in the oscillator circuit when transistor $34_1$ is conducting. The capacitors $33_1$ to $33_N$ each have a small capacitance because they are used for adjusting the frequency over a very small range. Accordingly, fine adjustments are made to frequency with the disadvantages of the trimmer condenser eliminated, and only a small change in frequency is made by the addition or removal of a single capacitor 33. It should, therefore, be understood that in the aggregate, a large range of frequency adjustment is possible by means of the capacitors $33_1$ through $33_N$.

In the above example, the capacitor was changed to adjust frequency, but it should be understood that a resistor, or any element which can change the frequency of the oscillator circuit, may be used in conjunction with the memory outputs and an electronic switch. An electronic timepiece with high accuracy, wherein the time needed for measuring the accuracy can be shortened, is obtained by providing this frequency adjuster circuit 10.

In this invention, a mechanical switch which is controlled from outside the timepiece and a non-volatile memory are utilized in the memory 8. In the following explanation, FAMOS are utilized in the non-volatile memory.

Figure 4:
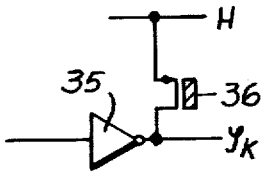
Figure 5:
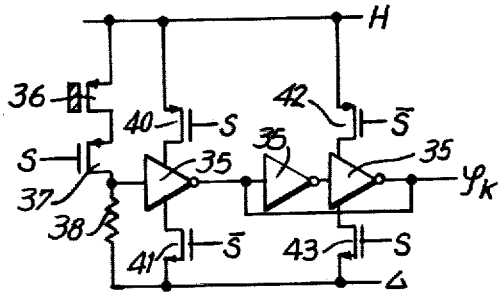

FIGS. 4 and 5 show examples of memory circuitry comprising the memory device FAMOS 36, inverter 35, resistor 38, and MOS transistors 37, 40, 41 and 43. In FIG. 4, when the FAMOS 36 is in the condition of ON, the high logic condition H is applied to $\phi_K$ regardless of the input of the inverter 35, (hereinafter high and low logic conditions are referred to as H and L). When the FAMOS 36 is OFF, what is obtained by reversing the input to the inverter 35 is applied to $\phi_K$. Therefore, if H is applied to the inverter 35, H is applied to $\phi_K$ when the FAMOS 36 is ON, and L is applied to $\phi_K$ when the FAMOS 36 is OFF. The memory is driven in the above-described manner.

Figure 6:
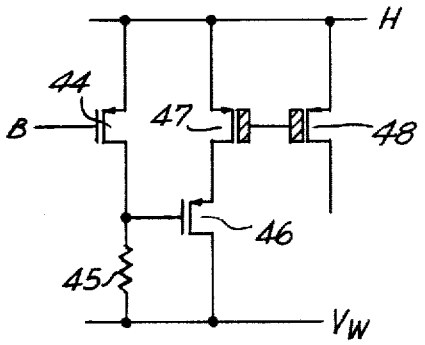
Figure 7:
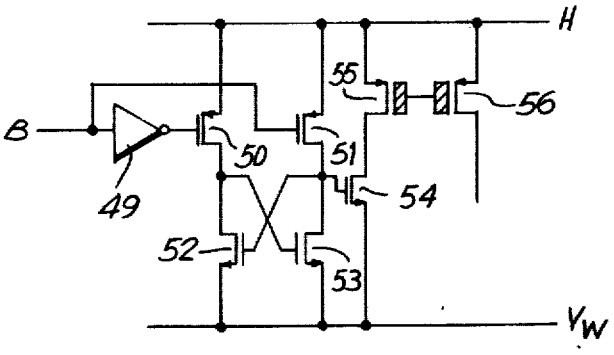
Figure 8:
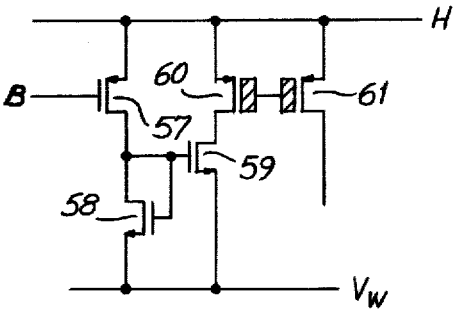

In FIG. 5, the static memory is combined with the memory shown in FIG. 4. In the same manner as that of the example shown in FIG. 4, ON and OFF of the FAMOS 36 are converted into the logic conditions H and L by high resistance of the resistor 38. In this example, the information is written into the static memory through a clocked gate. Thus, the current which runs through the FAMOS can be made zero except at the time when it is written into the static memory. Thus economy of power is achieved through use of the FAMOS. In an alternative embodiment of this circuit the resistor 38 can be replaced by a transistor. In the following description of this invention, the dual gate type element is utilized as the FAMOS transistor element, but the FAMOS transistor element is not limited to the dual gate type. Circuit means for writing into the FAMOS elements as shown in FIGS. 6, 7 and 8 are suitable in alternative embodiments of this invention. In FIG. 6, 44 and 46 are MOS transistors, 45 is a resistor and 47 and 48 are FAMOS transistor elements of the dual gate type. The write-in voltage $V_W$ normally needs −30 to −40 volts. However, in certain circumstances, it is possible that the write-in voltage $V_W$ can be reduced by providing an N-plus region in the drain side of a P-channel FAMOS element and decreasing the drain breakdown voltage as shown in the front view of FIG. 9*a* and the side view of FIG. 9*b*.

In FIG. 6 when L is applied to gate B of the MOS transistor 44, the MOS transistor 44 turns ON. If the resistor 45 is selected to have a higher impedance than the ON-impedance of the conducting MOS transistor 44, substantially H is applied to the gate of the MOS transistor 46. In this condition, the MOS transistor 46 is OFF and the FAMOS element 47 is not written into.

To the contrary, when H is applied to the gate of the MOS transistor 44, the MOS transistor 44 turns OFF and $V_W$ is applied to the gate of the MOS transistor 46. At that time, if the write-in voltage $V_W$ is set to be less than the ON-potential of the MOS transistor 46 (the absolute value of $V_W$ is more than that of ON-potential of the MOS transistor 46) and less than the write-in voltage of the FAMOS 47 (the absolute value of $V_W$ is more than that of write-in starting voltage of the FAMOS element 47), the MOS transistor 46 turns ON and the FAMOS is written into.

FIGS. 7 and 8 show circuit structures which are not provided with the resistor 45 as in FIG. 6. In FIG. 7, a circuit for writing comprises the inverter 49, MOS transistors 50, 51, 52, 53 and 54, and dual gate FAMOS elements 55 and 56. In this circuit a flip-flop is used in which P-channel MOS transistors and N-channel MOS trasnsistors are combined. When H is applied to B, the MOS transistors 50, 53 turn ON and the write-in voltage $V_W$ is applied to the gate of the MOS transistor 54. At this time, as $V_W$ has a negative voltage value, the MOS transistor 54 turns OFF and the FAMOS element 55 is not written-in. To the contrary, if L is applied to B, the transistors 51 and 52 turn ON and the MOS transistor 54 also turns ON, and so the FAMOS element 55 is written-in.

In the circuit shown in FIG. 8, reference numbers 57, 58 and 59 show MOS transistors, and 60 and 61 show dual gate FAMOS elements. In this circuit, when H is applied to B, the MOS transistor 57 is turned OFF (non-conducting) and $V_W$ is applied to the gate of MOS transistor 59. However, $V_W$ is a negative voltage so the MOS transistor 59 is made non-conducting and the dual gate FAMOS element 60 cannot then be written-into. On the other hand, when L is applied to B, the MOS transistor 57 is turned ON, therefore the MOS transistor 59 is also turned ON and the dual gate FAMOS element 60 is written.

In the above-described circuits, the FAMOS element was a P-channel FAMOS. However, N-channel FAMOS can also be employed in a similar manner. Although the structure of the write-in circuit is somewhat changed when using an N-channel FAMOS, the principles are quite the same as that in the case of a P-channel FAMOS.

Both P-channel and N-channel FAMOS elements can also be applied to the circuitry shown in FIGS. 4 and 5. Moreover the above described circuits and principles can also be applied to non-volatile memory elements other than FAMOS elements. In this invention, the FAMOS element is employed as merely one example of non-volatile memory elements, and similar circuits can also be achieved easily by employing a fuse type or a breaking type of diode junction.

Next the comparator 7 shown in FIGS. 1 and 2 is described. FIG. 10 shows one embodiment thereof. The reference numbers $62_1$ to $62_{N-1}$ and 63 indicates NAND gates. This is an embodiment wherein a binary up-counter is used in the divider. When $\phi_K$ is H, $\bar{\phi}_K$ is L. That is to say, when $0_K$ is H, the output from the NAND gate $62_K$ becomes H, and when $\phi_K$ is L, the output from the NAND gate $62_K$ becomes H regardless of the state whether $\bar{\phi}_K$ is H or L. After the output 19 from the counter 5 begins to drive NAND gate 63, it is the moment when each output from the NAND gates $62_1$ to $62_{N-1}$ becomes H that the NAND gate 63 outputs the signal 45 to the reset circuit 6. That is to say, when $\phi_K$ is H, $\phi_K$ is H, and when $\phi_K$ is L, $\phi_K$ may be H or L. However, since an upcounter is used in the divider, $\phi_K$ is L.

Replacing the embodiment shown in FIG. 10, a circuit employing exclusive OR gates can be used as shown in FIG. 11. Set and reset counters, as shown in FIG. 12, can be used for the set and reset counters $6_1$ and 25 in FIG. 2. The NAND gate shown in FIG. 13 can be used for the comparator $6_2$ in FIG. 2.

Next, circuit means for inputting information to be written into the memory will be described. In one type of circuitry the information is inputted directly, as for example, into the terminal B shown in FIGS. 6, 7 and 8. However, such a direct write-in method causes a serious problem in that it takes considerable time to accomplish, and the need for a large number of terminals also causes a serious problem in that they take up considerable space in the timepiece. This next circuit eliminates the above-mentioned faults. FIG. 14 shows a circuit embodiment wherein a time series pulse signal (sequential signals) is input from outside the timepiece and the information thereof is written-in to memory.

Figure 15:
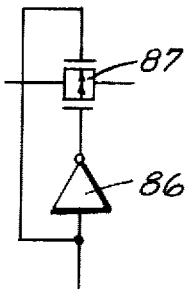
Figure 16:
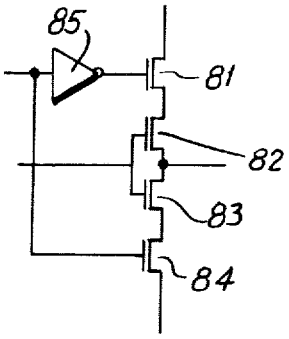

In FIG. 14, dividers $69_1$ to $69_N$ show a part of the group of dividers shown in FIG. 1 of this invention. The dividers $69_2$ to $69_N$ correspond to the number of FAMOS elements used in the memory 8; that is, the number of dividers is N−1. Reference numbers 70 and 72 show the transmission gates or clocked inverters shown in detail in FIGS. 15 and 16.

Operation of the circuits of FIG. 14 is now described. Ordinarily, while the timepiece is operated, the transmission gates, or clocked inverters 70 and 72, are turned ON and the transmission gate, or clocked inverter 71, is turned OFF, which condition is determined by the signal on line 78. Consequently, the signal input into the terminal 80 is divider as required by dividers $69_1$ to $69_N$, thereafter the low frequency signal is outputted to the terminal 79. The same signal as the signal obtained at the terminal 79, is outputted through the transmission gate or clocked inverter 72 to the outside as a signal on line 73. The signal on line 73 is transmitted from the timepiece to an external adjusting device (not shown). The external adjusting device detects the signal being transmitted thereto, measures the rate, and generates a rate adjusting signal. The nature of the external adjusting device in this situation does not limit the timepiece of this invention. The externally derived rate adjusting signal is transmitted through the same line 73 back to the timepiece. In this case, that is, in order to receive the adjusting signal, the transmission gates or clocked inverters 72 and 70 are turned OFF and the transmission gate or clocked inverter 71 is turned ON by the signal of line 78.

Therefore, the rate adjusting signal is input into dividers $69_2$ to $69_N$ through the lines 73 and 75, transmission gate or clocked inverter 71, and line 76, so that the rate adjusting signal is stored in dividers $69_2$ to $69_N$. Thereafter, the stored contents is transmitted to FAMOS elements through the terminals $69_2'$ to $69_N'$. The information to be written-in the FAMOS is transmitted as described above. Thus, it is seen that stages of the divider serve as a storage register when information is to be written into the memory. It is needless to say that the information to be written-in is transmitted to the FAMOS after dividers $69_2$ to $69_N$ become set at the states predetermined by the adjusting signal.

Next, circuit means for rapidly measure the rate of the timepiece will be described briefly according to FIG. 2. In FIG. 2, the signal for regulation is the output from the divider 5p. However, the rate also can be measured by inputting the signal of divider $2_N$ into the differentiating circuit 24. That is to say, the signal of divider $2_N$ is transmitted to the outside of the timepiece via the differentiating circuit 24 or some means, such as an exteranal terminal coupled to a display mechanism 4, or a device for driving the display mechanism 4. Thereby the signal of the divider stage $2_N$ is detected externally and the signal rate can be measured to indicate operation of the timepiece.

In alternative embodiments of this invention, the rate can also be measured, not only by inputting the signal of divider $2_N$ into the differentiating circuit 24, but also by inputting the signal of any divider stage provided after stage $2_N$ in the divider 2. Further, the signal which is detected externally does not need to be limited only to the signal which is input to the differentiation circuit 24. It is also possible in an alternative embodiment to use the signal of line 73 in FIG. 14 as the signal which is made available outside the timepiece for rate measurements. Also in this embodiment, the circuits shown in FIGS. 15 and 16 can be employed.

The description above mainly relates to examples wherein FAMOS elements are applied to perform regulation. However, the rate can be similarly adjusted by a plurality of external terminals 21, 22 (FIG. 1) which means are effective should the oscillator rate change due to long years of use or external circumstances. Via these external terminals, modified data is stored in a programmable memory. In inputting information to the memory circuit via the external terminals, mechanical switches are generally used. Examples of these mechanical switches are shown in FIGS. 17 through 20 wherein moving contacts are identified by the reference number 100 and fixed contacts by the reference number 102.

Figure 17:
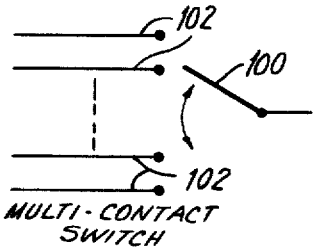
FIGS. 17 through 20 show mechanical switches suited for use in the timepiece of FIGS. 1 and 2.
Figure 18:
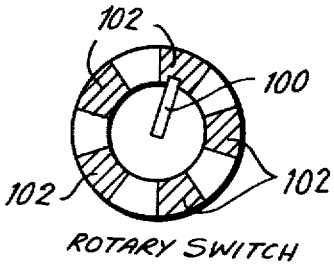
Figure 19:
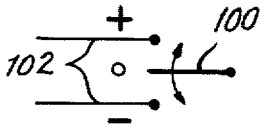
Figure 20:
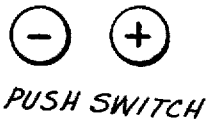

FIG. 17 shows an example of a multicontact switch and FIG. 18 shows an example of a rotary switch. FIG. 19 shows an example of a three-position switch having two fixed contacts, which changes over the rate of adjustment to the plus side, minus side, or zero. The principle of FIG. 19 can also be applied to a [N+1]—position switch having N contacts where N is a natural number. FIG. 20 shows a push-switch, which adjusts the rate step by step to the plus side or minus side as required.

A timepiece which is always accurate can be obtained by suitably combining the rate adjustment by the above-mentioned switches and by the contents written in the above-mentioned FAMOS elements.

Next, a time regulating means which is different from the regulating means in FIGS. 1 and 2 described above, will be described with reference to block diagram FIG. 21 and the time chart of FIG. 22. The output 90 from the counter $5_P$ passes through the circuit 89 and is input into the divider $2_{N+1}$ as a reset pulse. It is simultaneously input into the circuit $88_N$. The circuit $88_N$ performs the following two functions according to the state of $\phi_N$. The first function (A) is to output a reset signal 92 to the divider $2_N$ at the moment the output from the divider $2_N$ becomes H. The second function (B) is to output a reset signal 92 to the divider $2_N$ at the moment the output 91 is input into the circuit $88_N$. The selection of the function (A) or (B) is determined by the logic level of the memory 8. This is the same principle as the embodiment of FIG. 1.

Figure 21:
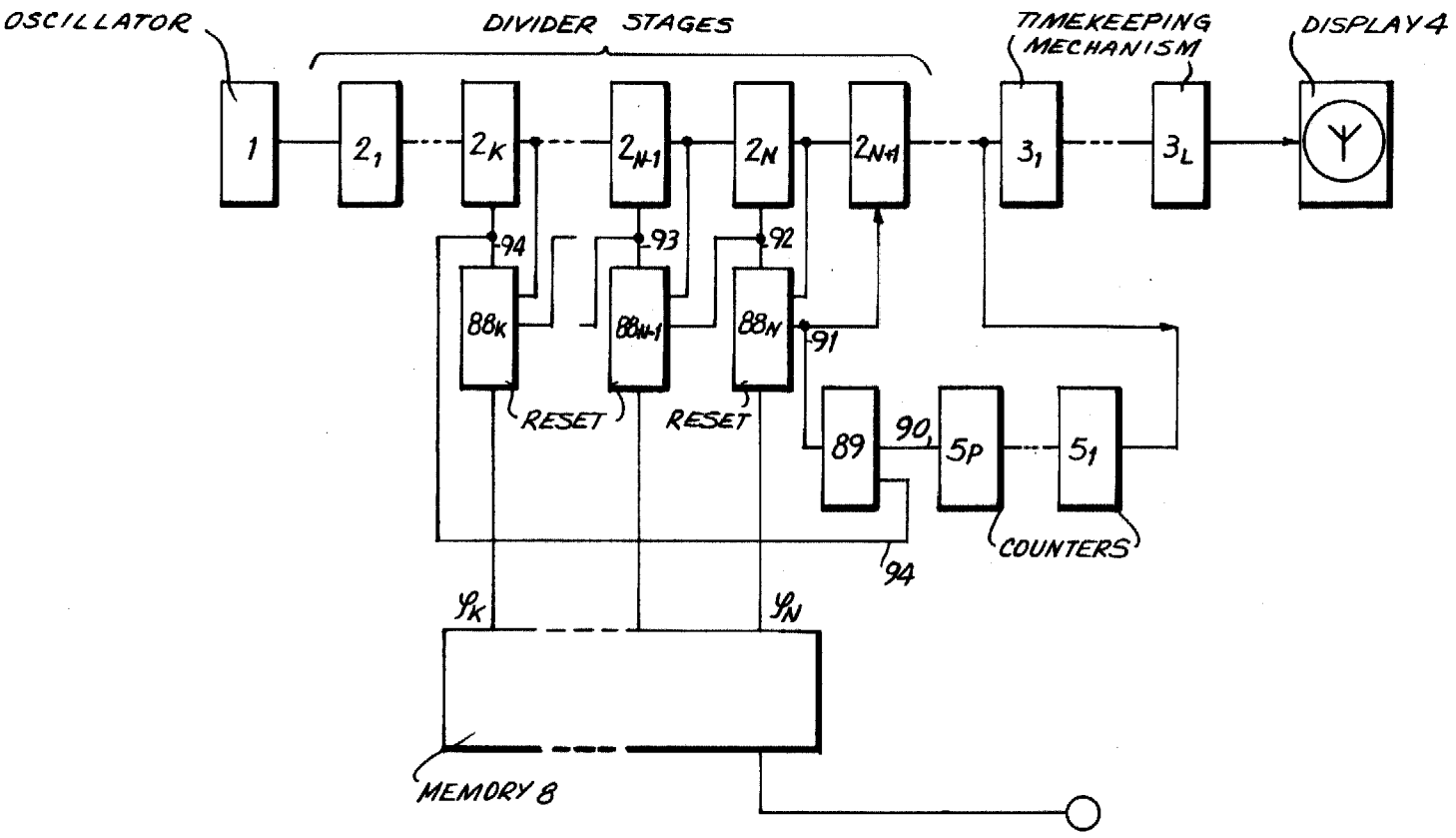
FIG. 21 is a functional block diagram showing an alternative embodiment of a timepiece of this invention.
Figure 22:
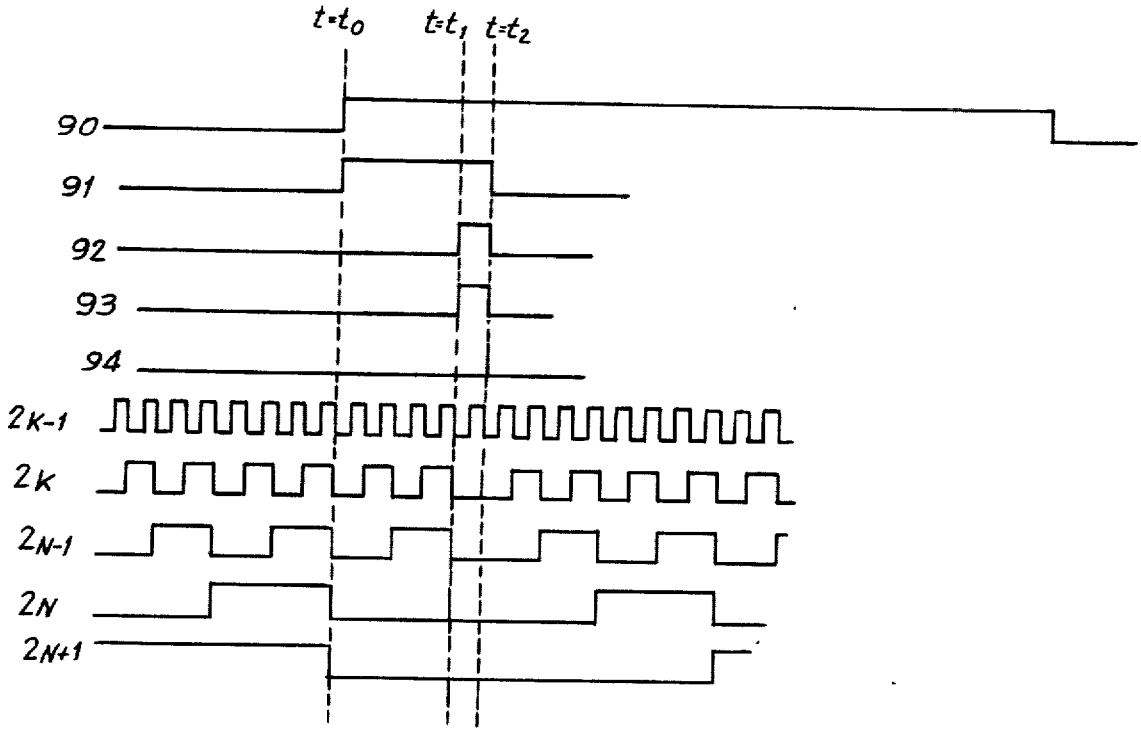
FIG. 22 is a wave form diagram illustrating operation of the timepiece of FIG. 21.

In the invention of FIG. 21, the dividers $2_1$ to $2_N$ consist of binary counters, the output of which is L in a reset state. When $\phi_N$ is L, the circuit $88_N$ performs the above-mentioned function (A), while when $\phi_N$ is H, it performs the above-mentioned function (B). The logic state of $\phi_N$ determines which function the circuit $88_N$ performs, (A) or (B), and the circuit $88_N$ outputs the reset signal 92 to reset the divider $2_N$. The reset signal 92 is input also into the circuit $88_{N-1}$.

The function of the circuit $88_{N-1}$ is the same as that of the circuit $88_N$, namely it performs the function (A) or (B) described above according to the memory contents of $\phi_{N-1}$. Moreover the circuits $88_{N-2}$ to $88_K$ also perform the same function, so that all the dividers $2_K$ to $2_N$ are reset. The output 94, which resets divider stage $2_K$, is also input into the circuit 89 to turn it off, so that the dividers $2_K$ to $2_N$ are released from reset. Divider $2_{N+1}$ connected directly to the otuput of circuit 89 is also released from reset. Thus one cycle of regulation is completed.

Next this regulating method will be described according to the time charge presented in FIG. 22. Using FIG. 21 as an example, $N=K+2$, $\phi_K=\phi_N=L$ and $\phi_{N-1}=H$. The output 90, output from the counter $5_P$ passes the circuit 89, and the divider $2_{N+1}$ is reset at $t=t_0$. At the same time, the signal is input also into the circuit $88_N$ and stands by until the output from the divider $2_N$ becomes H. Then, the moment the output becomes H, the reset signal 92 is output to the divdier $2_N$ to reset the divider $2_N$. ($t=t_1$). This reset signal is input also into the circuit $88_{N-1}$. Since $\phi_{N-1}$ is H, the reset signal 92 passes the circuit $88_{N-1}$ and is outputted as the reset signal 93, so that the divider $2_{N-1}$ is reset. Moreover, the reset signal 93 is input also into the circuit $88_K$. Since $\phi_K$ is L, the signal input into the circuit $88_K$ stands by until the output from the divider $2_K$ becomes H, and the moment it becomes H, namely at $t=t_2$, the output 94 is output as a reset signal, so that the divider $2_K$ is reset. Furthermore, the output 94 is input also into the circuit 89 to turn it OFF.

Thus, one cycle of regulation is completed. Consequently, five pulses of the output of divider $2_{K-1}$ are effectively subtracted in those divdiders and the frequency delivered to the timekeeping mechanism 3 is adjusted corresponding to these five pulses. More particularly, the output of stage $2_{N+1}$ occurs after 13, and not 8, pulses of stage $2_{K-1}$.

In the case where the output 91 is input into the divider $2_{N+1}$ as a set pulse instead of a reset pulse, and all other signals remain the same, then three pulses are effectively added to the output of divider $2_{K-1}$, in that only 13, and not 16, pulses from divider state $2_{K-1}$ produce two pulses from divider stage $2_{N+1}$.

As described above the frequency is adjusted to make the timepiece gain or lose by the logic state of $\phi_K$ to $\phi_N$ in the dividers. The above description (FIGS. 21, 22) refers to an embodiment where the set pulse is input only into the divider $2_{N+1}$, however, it is also possible to input the set pulse into any divider or many dividers.

This divider regulating means described with reference to FIGS. 21, 22 can be substituted for that described in the embodiments in FIGS. 1 and 2. The description applicable to FIGS. 1 and 2 except for the regulating methods shown in FIGS. 1 and 2, are still applicable with the incorporation of the divider regulating method of FIGS. 21, 22.

Figure 23:
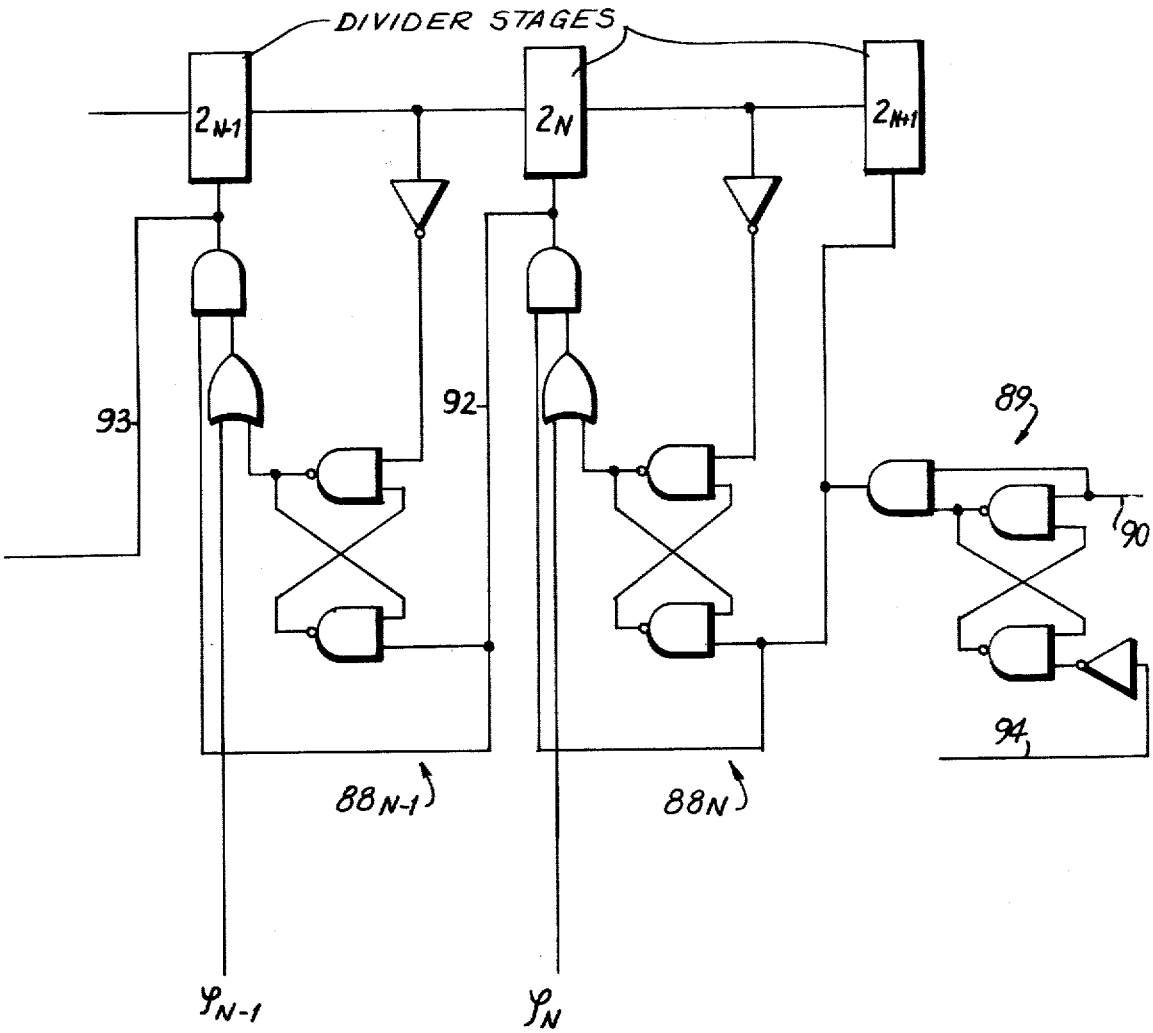
FIG. 23 is a semi-schematic diagram indicating logic associated with the timepiece of FIG. 21.

FIG. 23 shows a detailed circuit according to the regulating means of FIG. 21. As mentioned above, this invention makes it possible to regulate an electronic timepiece over a wide range as well as with high accuracy.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention, which, as a matter of language, might be said to fall therebetweeen. What is claimed is:

1. A timing apparatus for producing timekeeping signals comprising:

a fundamental frequency oscillator producing a high frequency time standard signal;

a plurality of sequential divider stages coupled to said oscillator for dividing the frequency of said time standard signal, at least one of said divider stages being capable of being reset and at least one of said divider stages being capable of being set, the divided frequency output of said divider stages being suited to produce timekeeping signals; and memory means for holding stored data; and first circuit means for selectively applying control signals to as least a portion of said plurality of divider stages, said portion including a divider stage subject to being selectively set in response to said control signals and a divider stage subject to being selectively reset in response to said control signals, said control signals being applied in accordance with said data stored in said memory, whereby the frequency of said timekeeping signals is selectively increased or decreased; and second circuit means for time delaying said control signals by differing amounts to said portion of said divider stage, wherein upon receiving said control signal from said first circuit means the said portion of the divider stages are reset or set in accordance with said time delay.

2. The timing apparatus of claim 1, and further comprising frequency adjustment means, said adjustment means acting to change the fundamental output frequency of said oscillator.

3. The timing apparatus of claim 2, wherein said frequency adjustment means includes a plurality of elements, each of said elements when switched into the circuits of said osccillator, individually causing a small change in said fundamental frequency, and means for selectively switching said elements into or out of said oscillator circuit.

4. The timing apparatus of claim 3, wherein said switchable elements are capacitors, and said means for selectively switching include said memory means.

5. The timing apparatus of claim 1, wherein said means second circuit for delaying signals is adapted to reset divider stages successively back toward said fundamental frequency oscillator.

6. The timing apparatus of claim 3, wherein said memory means is non-volatile.

7. The timing apparatus of claim 6, wherein said non-volatile memory means includes FAMOS transistor elements.

8. A timing apparatus for producing timekeeping signals comprising:

a fundamental frequency oscillator producing a high frequency time standard signal;

a plurality of sequential divider stages coupled to said oscillator for dividng the frequency of said time standard signal, at least one of said divider stages being capable of being set and reset, the divided frequency output of said divider stages being suited to produce timekeeping signals;

memory means for holding stored data;

first comparator means, said first comparator means receiving the outputs of a plurality of said divider stages and, when enabled, comparing said outputs with said data stored in memory, the coincidence of said divider signals and said stored data causing said enabled comparator means to output a signal;

a set-reset counter, said set-reset counter out-putting a control signal applied to at least a portion of said plurality of divider stages including at least one divider stage capable of being reset, said control signal also being applied to selector means, said selector means outputting a signal to said divider stage being capable of being set and reset in accordance with said data stored in said memory, said control signal also disabling said comparator;

counter means for further reducing the divided frequency output of said divider stages;

means for differentiating the low frequency output of said cunter means and inputting the differentiated signal to said comparator, whereby said comparator is enabled; and second comparator means for determining that selected divider stages are reset by said control signal, said second comparator means resetting said set-reset counter when said divider stages are reset.

9. The timing apparatus of claim 8, wherein said memory means is non-volatile.

10. The timing apparatus of claim 8, wherein said data is written into said memory means from an external source.

11. The timing apparatus of claim 10, wherein said non-volatile memory means includes FAMOS transistor elements.

12. The timing apparatus of claim 8, and further including means for presenting signals for external detection, said signals being indicative of a divided fundamental frequency, whereby said externally inputted data is based upon said externally detected signals.

13. The timing apparatus of claim 8, and further including circuit means for selectively applying control signals to at least a portion of said plurality of divider stages to change the output thereof in accordance with said data stored in said memory, whereby the frequency of sad timekeeping signals is selectively increased or decreased; and circuit means for temporarily holding data inputted from external sources to said timing apparatus prior to storage of said data in said memory means, said circuit means for temporarily holding data including at least part of said plurality of divider stages.

14. The timing apparatus of claim 13, and further including comparator means, said comparator means receiving the outputs of a plurality of said divider stages and comparing said outputs with said data stored in memory, the coincidence of said divider signals and said stored data causing said circuit means to apply said control signals.

15. The timing apparatus of claim 14, and further comprising frequency adjustment means, said adjustment means acting to change the fundamental output frequency of said oscillator.

16. The timing apparatus of claim 15, wherein said frequency adjustment means includes a plurality of elements, each of said elements when switched into the circuits of said oscillator individually causing a small change in said fundamental frequency, and means for selectively switching said elements into or out of said oscillator circuit.

17. A timing apparatus for producing timekeeping signals comprising:

a fundamental frequency oscillator producing a high frequency time standard signal;

a plurality of sequential divider stages coupled to said oscillator for dividing the frequency of said time standard signal, the divided frequency output of said divider stages being suited to produce timekeeping signals;

memory means for holding stored data;

circuit means for selectively applying control signals to at least a portion of said plurality of divider stages to change the output thereof in accordance with said data stored in said memory, whereby the frequency of said timekeeping signals is selectively increased or decreased;

circuit means for temporarily holding data inputted from external sources to said timing apparatus prior to storage of said data in said memory means, said circuit means for temporarily holding data including at least part of said plurality of divider stages; and comparator means, said comparator means receiving the outputs of a plurality of said divider stages and comparing said outputs with said data stored in memory, the coincidence of said divider signals and said stored data causing said circuit means to apply said control signals.

18. The timing apparatus of claim 17, and further comprising frequency adjustment means, said adjustment means acting to change the fundamental output frequency of said oscillator.

19. The timing apparatus of claim 18, wherein said frequency adjustment means includes a plurality of elements, each of said elements when switched into the circuits of said oscillator, individually causing a small change in said fundamental frequency, and means for selectively switching said elements into or out of said oscillator circuit.

20. The timing apparatus of claim 19, wherein said switchable elements are capacitors, and said means for selectively switching include said memory means.

21. The timing apparatus of claim 17, wherein said selectively applied control signals selectively set or reset divider stages to change the output thereof.

22. A timing apparatus for producing timekeeping signals comprising:

a fundamental frequency oscillator producing a high frequency time standard signal;

a plurality of sequential divider stages coupled to said oscillator for dividing the frequency of said time standard signal, at least one of said divider stages being capable of being set and reset, the divided frequency output of said divider stages being suited to produce timekeeping signals;

memory means for holding stored data;

counter means for further reducing the divided frequency output of said divider stages; and circuit means associated with at least a portion of said divider stages, said circuit means being enabled by the output of said counter means and selectively resetting successively associated divider stages in accordance with said data stored in said memory.

23. The timing apparatus of claim 22, wherein said selectively set or reset divider stages respond immediately to said circuit means.

24. The timing apparatus of claim 22, wherein said selectively set or reset divider stages respond after a delay to said circuit means.

25. A timing apparatus for producing timekeeping signals comprising:

a fundamental frequency oscillator producing a high frequency time standard signal;

a plurality of sequential divider stages coupled to said oscillator for dividing the frequency of said time standard signal, the divided frequency output of said divider stages being suited to produce timekeeping signals;

memory means for holding stored data;

circuit means for applying control signals to at least a portion of said plurality of divider stages, whereby all or a portion of said plurality of divider stages are selectively set or reset by said control signals, or a first portion of said plurality of divider stages is set by said control signals while a second portion of said divider stages is reset by said control signals, in accordance with said data stored in said memory; and divider stages which reset successively in response to said control signals and divider stages which set successively in response to said control signals, and the frequency of said timekeeping signals may be selectively increased or decreased.

26. A timing apparatus for producing timekeeping signals comprising:

a fundamental frequency oscillator producing a high frequency time standard signal;

a plurality of sequential divider stages coupled to said oscillator for dividing the frequency of said time standard signal, at least one of said divider stages being capable of being reset by a control signal and at least one of said divider stages being capable of being set by a control signal, the divided frequency output of said divider stages being suited to produce timekeeping signals;

memory means for holding stored data, said data being inputted from an external source to said timing apparatus for storage in said memory means;

means for presenting signals for external detection, said signals being indicative of a divided fundamental frequency, whereby said externally inputted data can be based upon said externally detected signals; and circuit means for applying to at least a portion of said plurality of divider stages said control signals, whereby a divider stage is subject to being selectively set and a divider stage is subject to being selectively reset, said control signals being applied in accordance with said data stored in said memory, whereby the frequency of said timekeeping signals is selectively increased or decreased.

27. The timing device of claim 26 or 25, and further comprising comparator means, said comparator means receiving the outputs of a plurality of said divider stages and comparing said outputs with said data stored in memory, the coincidence of said divider signals and said stored data causing said circuit means to apply said control signal.

28. The timing device of claim 26 or 25, wherein at least part of said plurality of divider stages is used to hold data inputted to said timing apparatus prior to storage of said data in said memory means.

29. The timing device of claim 26 or 25, and further comprising frequency adjustment means, said adjustment means acting to change the fundamental output frequency of said oscillator.

30. The timing device of claim 29, wherein said frequency adjustment means includes a plurality of elements, each of said elements when switched into the circuits of said oscillator, individually causing a small change in said fundamental frequency, and means for selectively switching said elements into or out of said oscillator circuit.

31. The timing device of claim 30, wherein said switchable elements are capacitors, and said means for selectively switching include said memory means.

32. A timing apparatus as claimed in claim 1, 26, 25, 17, 8 or 22, and further comprising an external member, said memory means being adapted to receive inputs to said stored data by operation of said external member, whereby the frequency of said timekeeping signals is further adjusted.

33. A timing apparatus of claim 32, wherein said external member is selected from a group including push-button switches, a rotatory switch, a single pole multi-contact switch, a three-position switch wherein one position is an open circuit.

* * * * *